US007014085B2

(12) United States Patent
McCullough

(10) Patent No.: US 7,014,085 B2
(45) Date of Patent: Mar. 21, 2006

(54) EXPLOSIVELY ACTUATED TOOLS

(75) Inventor: David John McCullough, Victoria (AU)

(73) Assignee: Cetram PTY Limited, Victoria (AU)

( * ) Notice: Subject to any disclaimer, the term of this patent is extended or adjusted under 35 U.S.C. 154(b) by 0 days.

(21) Appl. No.: 10/873,299

(22) Filed: Jun. 23, 2004

(65) Prior Publication Data

US 2005/0011927 A1 Jan. 20, 2005

(30) Foreign Application Priority Data

Jul. 16, 2003 (AU) ..... 2003903682

(51) Int. Cl.
*B21J 15/28* (2006.01)
*B27F 7/17* (2006.01)

(52) U.S. Cl. ..... 227/8; 227/9; 227/10; 227/156

(58) Field of Classification Search ..... 227/8, 227/9, 156, 10

See application file for complete search history.

(56) References Cited

U.S. PATENT DOCUMENTS 4,479,599 A 10/1984 Conrad
5,425,488 A * 6/1995 Thompson ..... 227/10
5,429,291 A 7/1995 Thompson
5,465,893 A 11/1995 Thompson
2003/0116603 A1 * 6/2003 Connell et al. ..... 227/10
2004/0104257 A1 * 6/2004 McCullough ..... 227/10
2004/0245308 A1 * 12/2004 Arnold et al. ..... 227/10
2005/0011927 A1 * 1/2005 McCullough ..... 227/10

FOREIGN PATENT DOCUMENTS

EP 1 197 301 A2 4/2002

* cited by examiner

*Primary Examiner*—Scott A. Smith
*Assistant Examiner*—Brian Nash
(74) *Attorney, Agent, or Firm*—Lowe Hauptman & Berner, LLP

(57) ABSTRACT

An explosively actuated tool for driving a fastener into a substrate is mountable to the end of a pole-like handle to permit manipulation and actuation of the tool from a remote position. Actuation of the tool occurs by pushing the forward end of a barrel of the tool against the substrate using the handle and then pushing forwardly the handle which loads and then releases a tiring mechanism of the tool to fire the charge. The tool has a safety lock device for inhibiting loading of the firing mechanism sufficiently to initiate firing unless the tool is orientated upwardly into a vertical or near vertical orientation.

20 Claims, 3 Drawing Sheets

EXPLOSIVELY ACTUATED TOOLS

RELATED APPLICATIONS

The present application is based on, and claims priority from, Australian Application Serial Number 2003903682, filed Jul. 16, 2003, the disclosure of which is hereby incorporated by reference herein in its entirety.

BACKGROUND OF THE INVENTION

1. Field of the Invention

The present invention relates to an explosively actuated tool for driving a fastener, such as a pin, into a substrate, for example of concrete or steel.

2. Description of the Prior Art

Explosively actuated tools for driving a fastener, such as a pin, into a hard substrate, such as of concrete or steel, are in common use and operate by detonation of an explosive charge. In most prior tools of this type, detonation of the charge drives a piston within a barrel of the tool and the piston, in turn, drives the fastener which is positioned within the forward end of the barrel prior to firing. Tools of this general type will typically have a pistol grip and the tool is actuated by operation of a trigger associated with the grip.

A version of the tool has been developed for driving fasteners into substrates remote from the operator, for example for driving a fastener into a ceiling while the operator is still standing on the floor beneath the ceiling or for driving a fastener into a remote wall. This version of the tool is designed to be mounted at one end of a long handle or pole held by the operator. This version of the tool is termed a "pole tool". Such a pole tool is disclosed in U.S. Pat. No. 5,465,893. In this previously proposed pole tool, the barrel, which contains the fastener driving piston, is slidably mounted within the housing of the tool. The barrel is biased to a forwards position and when the forward end of the barrel is pressed against the substrate the barrel is caused to retract into the housing so that a charge chamber formed at the rear end of the barrel moves over and encloses the explosive charge. This occurs by the operator manipulating the pole so as to press the forward end of the barrel against the substrate. The pole itself is mounted to a firing pin mechanism of the tool and further pressing movement applied to the tool via the pole loads the firing pin mechanism which, when a predetermined loading is reached, releases the firing pin to detonate the charge.

The pole tool disclosed in U.S. Pat. No. 5,465,893 features a ball lock safety device which prevents the tool from being fired when the tool is orientated downwardly. Although the safety device is able to properly function to prevent firing in that orientation it is not designed to function to prevent the tool from being fired when in a substantially horizontal orientation or even in an orientation just below the horizontal.

The present applicants have determined that it is desirable for a lock device of this type to be effective over a range of orientations of the tool and particularly when the tool is orientated approximately horizontally which is the most likely orientation at which accidental or unintentional actuation is likely to arise.

SUMMARY OF THE INVENTION

According to the present invention there is provided an explosively actuated tool for driving a fastener into a substrate, said tool having a barrel from which a fastener is fired by firing of an explosive charge, a firing mechanism actuable by forwards displacement of a pole-like handle attached to a rear end of the tool to permit manipulation and actuation of the tool from a remote position, and a safety lock device for inhibiting actuation of the firing mechanism when the tool is orientated substantially horizontally or downwardly from the horizontal, said lock device comprising a locking ball moveable under gravity in response to the orientation of the tool, into a position in which it inhibits operation of the firing mechanism.

In a preferred embodiment of the invention, the firing mechanism includes a firing pin and a firing pin spring which is loaded by forwards movement of structure displaced by moving the handle forwardly relative to the tool housing, and the ball of the lock device inhibits firing by movement into a position in which it prevents forwards movement of said structure sufficient to effect firing when the tool is orientated substantially horizontally or downwardly from the horizontal.

In a practical embodiment of the invention, the said structure includes a coupling to which the pole-like handle is attached and the coupling is slidably mounted within an enclosure at the rear end of the tool housing, with the ball being located in a space defined between the coupling and a rear face of the enclosure such that in a firing-inhibiting position of the ball, the ball will lie against said rear face to prevent forwards displacement of the coupling to a position adjacent said rear face at which firing would otherwise be enabled, a forward face of the coupling providing a chamber into which the ball can move at predetermined orientations of the tool to thereby permit the coupling to move into the position adjacent said rear face and at which firing is enabled.

Particularly advantageously, a forward end face of the coupling is configured to provide a surface leading into the chamber and along which the ball will roll into the chamber when the tool is orientated vertically upwardly or within a predetermined angle to the vertical, and the chamber is defined by a circumferential surface along which the ball will roll out of the chamber when the tool is subsequently lowered to a substantially horizontal inclination.

In a practical form of the invention the circumferential surface defining the chamber is of conical form with the axis of the surface lying longitudinally of the tool. The chamber itself is of annular form extending around a firing pin spring support forming part of said structure and to which the coupling is connected. In this practical form of the invention, forwards displacement of the coupling and thereby the firing pin spring support to a position at which firing is enabled corresponds to movement of the firing pin spring support into a forwards position at which a firing pin pawl is caused to displace thereby releasing the firing pin itself.

Further according to the invention, there is provided an explosively actuated tool for driving a fastener into a substrate by firing of an explosive charge, the tool being of the type in which the tool is mountable to the end of a pole-like handle to permit manipulation and actuation of the tool from a remote position wherein actuation of the tool occurs by pushing the forward end of a barrel of the tool against the substrate using the handle and then pushing forwardly the handle which loads and then releases a firing mechanism of the tool to fire the charge, wherein the tool has a safety lock device for inhibiting loading of the firing mechanism sufficiently to initiate firing unless the tool is orientated upwardly into a vertical or near vertical orientation, the lock device comprising a locking ball which, when the tool is moved upwardly into a vertical or near vertical orientation, will roll by gravity into a position in which it is unable to inhibit loading and release of the firing mechanism and when the tool is lowered out of the vertical or near vertical orientation to a horizontal orientation the ball will roll out of said position into a position in which it will block forwards movement of the handle to an extent sufficient to prevent firing.

It is to be understood that tools in accordance with the invention might also have one or more further safety lock devices to inhibit or prevent firing in the event that other operational requirements are not fulfilled, for example if the front end of the barrel is not displaced into a rearwards position by pressing against the substrate. It is to be understood that if such other safety lock devices are incorporated, although the safety lock device of the invention may be in a condition to enable firing when the tool is held in the required orientation, actually to permit firing to take place the firing inhibiting or locking actions provided by such other safety lock devices must also be overcome. In other words it is not only necessary to ensure that the tool is held in the required orientation to permit operation but also other actions on which the or each other safety device is dependent must also be undertaken.

BRIEF DESCRIPTION OF THE DRAWINGS

An embodiment of the invention will now be described by way of example only with reference to the accompanying drawings in which.

DESCRIPTION OF THE PREFERRED EMBODIMENTS

Figure 1:
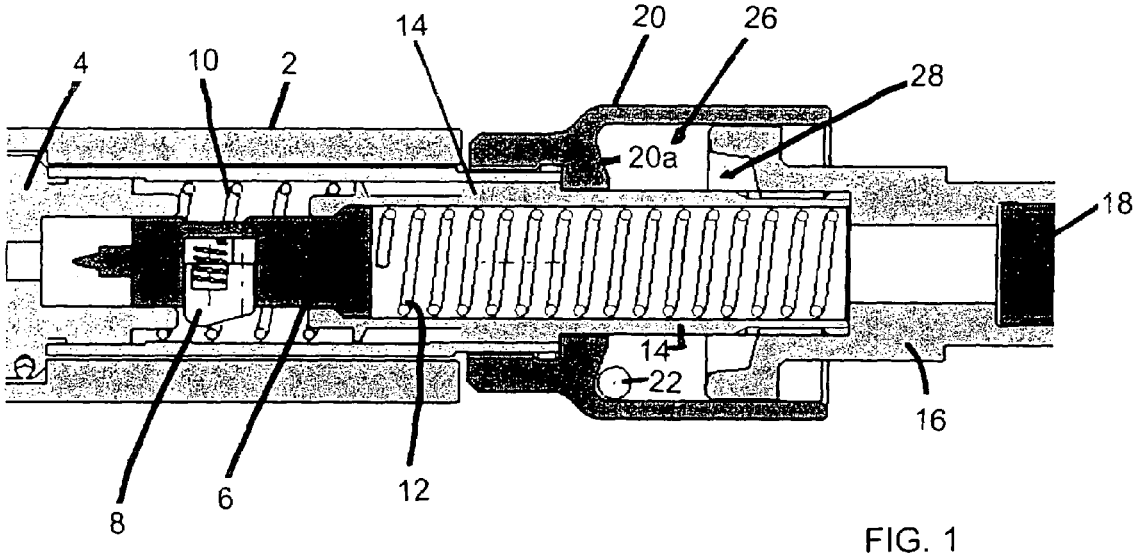
FIG. 1 shows schematically the rear part of a pole tool incorporating a ball lock safety device in accordance with a preferred embodiment of the invention.

A pole tool in accordance with the preferred embodiment of the invention is of the type disclosed in U.S. Pat. No. 5,465,893 discussed above and only those parts of the tool which relate to the improvement provided by the present invention will be described in detail. FIG. 1 shows schematically the rear part of the tool housing 2. A barrel (not shown) slidably mounted in the forward part of the housing contains a fastener driving piston and a charge chamber is formed at the rear end of the barrel. The barrel is biased into a forwards position by a compression spring mounted within the housing. A receiver body 4 for receiving an explosive charge carried by a charge strip in the manner illustrated in U.S. Pat. No. 5,465,893 and also in EP 1197301 is mounted in the housing 2 rearwardly of the rear end of the barrel when in a forwards position.

The receiver body 4 mounts a firing pin 6 which is held in a retracted READY position (as shown in FIG. 1) by a retractable spring loaded pawl 8 mounted within the firing pin 6 and releasably engageable with the rear end of the receiver body 4. The firing pin 6 is associated with a return spring 10 which operates to return the firing pin 6 to the READY position after firing. A firing pin spring 12 is housed within a tubular support 14 which is mounted within the tool housing 2 for sliding movement over the firing pin 6. At its rear end the support 14 carries an outer coupling 16 to which the pole-like handle 18 can be releasably attached. The coupling 16 is itself guided for sliding movement within a retaining collar 20 defining an enclosure at the rear end of the housing 2, and the collar 20 also provides sliding support for the firing pin spring support 14.

In operation, when the forward end of the barrel is placed against the substrate by manipulating the pole 18, and axial force is applied via the pole 18, the barrel is displaced inwardly in which its charge chamber moves over and encloses the explosive charge held in the operative position in the receiver body 4. At this point further axial force applied by the pole 18 displaces the firing pin spring support 14 forwardly along the firing pin 6 thereby loading the firing pin spring 12, the firing pin 6 being held in its retracted READY position by the spring loaded pawl 8. When the forward end of the firing pin spring support 14 meets the pawl 8, the pawl 8 is caused to retract thereby releasing the firing pin 6 for rapid movement forwardly within the receiver body 4 in order to detonate the explosive charge. After the tool has been fired and released from the substrate, the barrel is returned forwardly to its original position by the barrel return spring, and the firing pin spring support 14 is moved rearwardly to its original position by the firing pin return spring 10. The firing pin 6 itself is entrained by the support 14 during this movement and is thereby returned to its retracted READY position with the spring loaded pawl 8 projecting outwardly into engagement with the rear edge of the receiver body 4.

Figure 2:
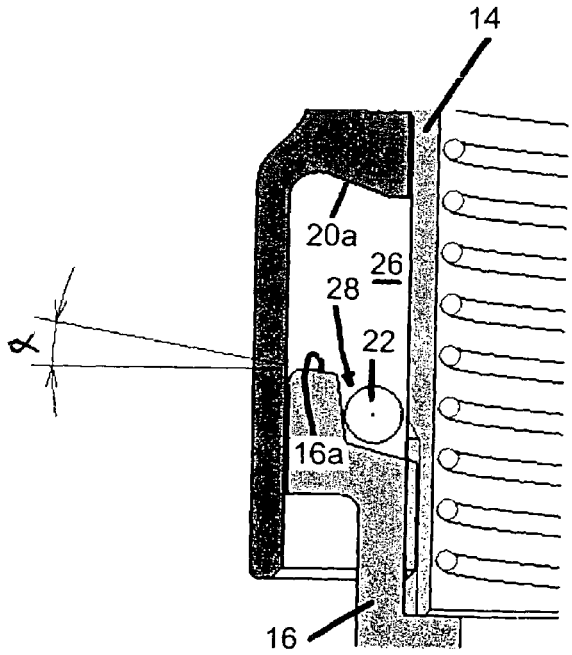
FIG. 2 shows schematically the configuration of a ball of the lock device when the tool is orientated vertically upwardly.
Figure 3:
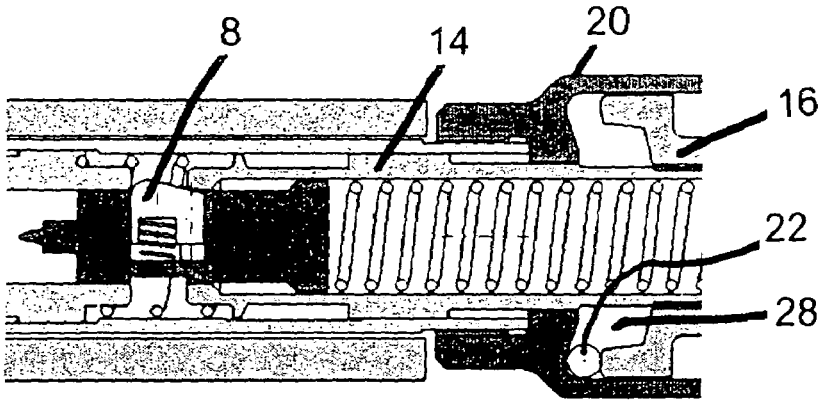
FIG. 3 shows the rear part of the tool and illustrates the configuration of the ball when in a position to inhibit firing when the tool is orientated approximately horizontally.

In accordance with the invention the tool has a ball lock safety device which is effective to prevent forwards movement of the firing pin spring support 14 by an extent sufficient to cause release of the firing pin pawl 8 except when the tool is orientated vertically or at an inclination above the horizontal. The lock device comprises a ball 22 housed within an annular chamber 26 defined between the coupling 16 and the retaining collar 20 within which the coupling 16 is mounted for sliding movement. As shown in FIG. 1, the ball 22 lies between a rear face 20*a* of the collar 20 and the forward end portion of the coupling 16. The coupling 16 is shaped to provide an annular chamber 28 lying rearwardly of the front face 16*a* of the coupling and in which the ball 22 is held captive at certain orientations of the tool as will be subsequently described; this is shown in FIG. 2. With the ball 22 held captive within the chamber 28, the coupling 16 is able to move forwardly to a position in which its front face 16*a* will lie in abutting engagement with, or closely adjacent, to the rear face 20*a* of the collar 20 and when in that position the firing pin spring support 14 attached to the coupling 16 will have moved sufficiently far forwardly to have caused release of the firing pin pawl 8. At other orientations of the tool as will be subsequently explained, the ball 22 will assume a position in which it is trapped between the front face 16*a* of the coupling 16 and the rear face 20*a* of the collar 20 thereby inhibiting movement of the coupling 16 and thereby the firing pin spring support 14 by a distance sufficient to cause release of the firing pin pawl 8; this is shown in FIG. 3. It is to be noted that the rear face 20*a* of the collar 20 is profiled to ensure that when the ball 22 is pushed against the rear face by the forwards movement of the coupling 16, the ball will be held captive in the outer peripheral part of the rear face 20*a* and can not thereby displace radially inwardly which would have the effect of releasing the locking effect which would otherwise be provided thereby.

As will be described, the design of the chamber 28 and in particular the outer wall 28*a* of the chamber 28 and which is of a conical shape is critical to the operation of the lock device. Likewise, the design of the front face 16*a* of the coupling 16 and the inclination of that front face leading into the outer wall 28*a* of the chamber 28 is important.

Figure 4:
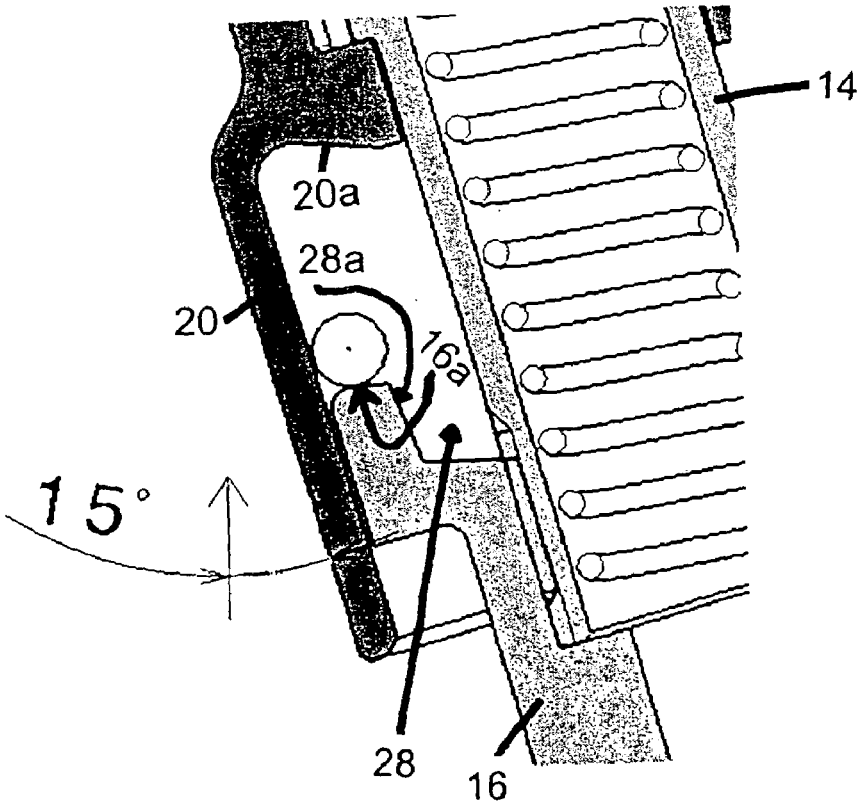
FIG. 4 is a view similar to FIG. 2 but showing the position of the ball when the tool has not been moved into an upright position within a predetermined angle of the vertical.
Figure 5:
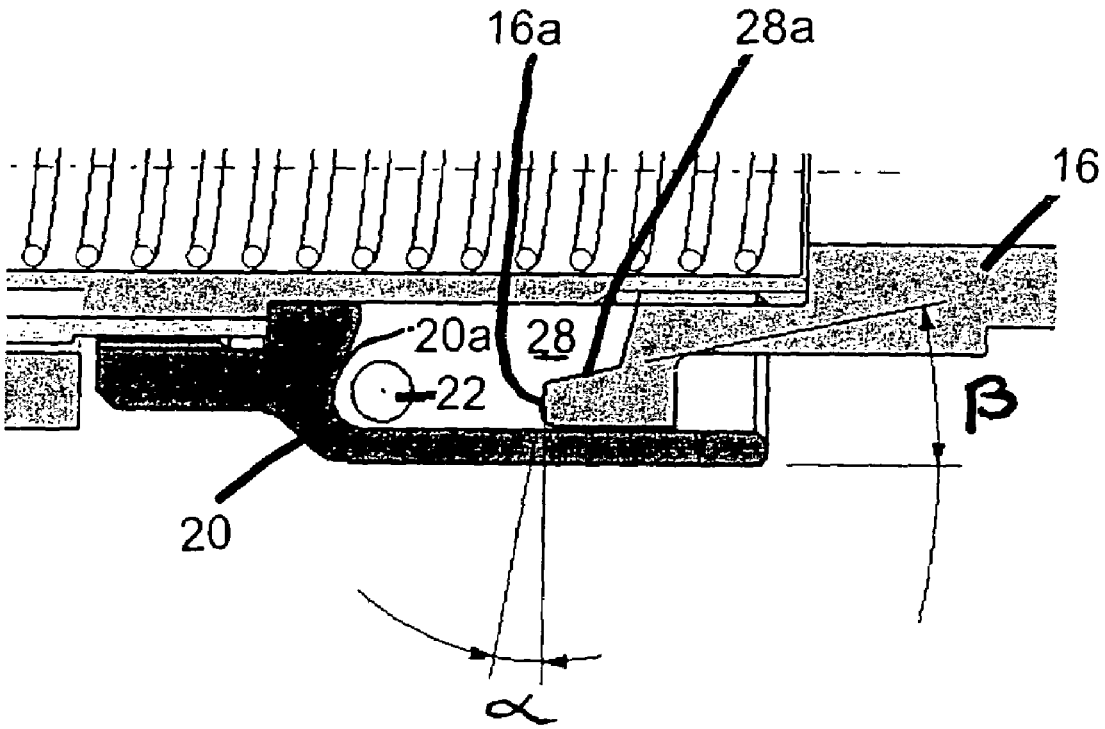
FIG. 5 is a view similar to FIGS. 2 and 4 and showing the position of the ball when the tool is orientated approximately horizontally.

To enable the tool to be fired, the tool must first be moved to an orientation in which the ball 22 is caused by gravity to roll into the chamber 28. With the configuration shown, this means that the tool must be held upwards vertically or close to the vertical. In that condition the front face 16*a* of the coupling will incline downwardly towards the chamber 28 so that the ball will roll along the face 16*a* into the chamber 28. The maximum angle at which the tool can be held from the vertical while still enabling the ball 22 to roll into the chamber 28 will depend on the angle of inclination $\alpha$ of the front face. That angle should be as small as possible consistent with ensuring that the ball 22 will always roll into the chamber 28 when the tool is orientated upwards either vertically or close to the vertical. In practice that angle will be around 10° and an angle of that general order will ensure consistent and reliable operation. FIG. 4 shows that when $\alpha$ is 10° and the tool is held at an inclination of 15° to the vertical the ball 22 will not roll into the chamber 28 until the tool is inclined closer to the vertical. When the ball 22 has rolled into the chamber 28, the tool is able to be fired as long as the ball 22 remains in the chamber 28. However if the tool is then lowered from the vertical orientation towards a more horizontal orientation, the outer wall 28*a* of the chamber 28 will incline closer to the horizontal until it reaches a point at which the lower part of the wall 28*a* on which the ball 22 will rest will be inclined downwardly to the horizontal whereby the ball 22 will roll out of the chamber 28. FIG. 5 illustrates the tool when orientated horizontally and it will be seen that the wall 28*a* has a significant downwards inclination at that orientation. It will therefore clearly be understood that when the tool is lowered from the vertical a situation will be reached that the downwards inclination of the wall 28*a* will be sufficient to cause the ball 22 to roll out of the chamber 28 before the tool actually reaches the horizontal. The inclination of the tool above the horizontal at which the ball 22 will roll out of the chamber 28 is determined by the angle $\beta$, the inclination of the wall 28*a* relative to the axis of the tool. While that angle should be as large as possible to ensure that the ball 22 will roll out of the chamber 28 while the tool is still at a substantial inclination above the horizontal, nevertheless in practice the inherent size limitations of the tool and associated structure do impose a practical limit on the size of that angle. It is also to be noted that the size of the angle $\beta$ will affect the radial depth of the front face 16*a*. As it is this face which will push the ball 22 against the rear face 20*a* of collar 20, the face 16*a* must be of a sufficient depth relative to the diameter of the ball to ensure reliable operation and this will impose constraints on the inclination of the wall 28*a*. However even with these constraints, the inclination can be configured to ensure that the ball will not remain within the chamber when the tool is inclined upwardly to the horizontal by an angle of less than approximately 10°.

Accordingly, in the tool thus described, to permit firing the tool must be orientated upwardly either vertically or close to the vertical to permit the ball to roll into the chamber and normally this would occur as part of the proper sequence of use of the tool whereby the operator orientates the tool substantially vertically towards a ceiling by manipulating the pole, and then applies the forward end of the barrel against the ceiling and pushes the pole upwardly to cause the barrel to displace inwardly to enclose the explosive charge and to drive the firing pin support forwardly to load the firing pin spring and cause release of the firing pin pawl.

In the event that the operator orientates the tool substantially vertically upwards to cause movement of the ball into the chamber but decides not to perform the further actions needed to actuate the tool, the tool will be disabled from subsequent actuation as soon as it is lowered to the horizontal to an extent sufficient to enable the ball to roll out of the chamber which in the practical example given is approximately 10° above the horizontal although depending on the design parameters could, and desirably should, occur at a greater angle to the horizontal. Nevertheless the major risk of inadvertent operation is likely to occur with the tool inclined by less than about 10° to the horizontal and operation in those circumstances will thereby be inhibited.

The ball lock safety device particularly described can readily be incorporated into some existing pole tool designs and all that is necessary to achieve this is to re-configure the collar which is attached to the rear end of the tool housing and to re-configure the pole coupling in the manner that has been described. However, other configurations of the ball lock safety device could be provided. For example, the ball could act in the manner described between the firing pin spring support and an appropriately shaped abutment surface within the interior of the tool housing.

The embodiment has been described by way of example only and modifications are possible within the scope of the invention.

Throughout this specification and claims which follow, unless the context requires otherwise, the word "comprise", and variations such as "comprises" or "comprising", will be understood to imply the inclusion of a stated integer or group of integers or steps but not the exclusion of any other integer or group of integers.

What is claimed is:

1. An explosively actuated tool, comprising:

a casing;

a handle being moveable relative to and projecting from a rear end of said casing;

a barrel which projects from a front end of said casing and from which a fastener is to be fired by firing of an explosive charge;

a firing mechanism actuable by forward displacement of the handle to a firing position; and a safety lock device for inhibiting actuation of the firing mechanism when the barrel is orientated substantially horizontally or downwardly from the horizontal, said lock device comprising a locking ball moveable under gravity in response to the orientation of the barrel, into a locking position in which said ball inhibits actuation of the firing mechanism;

wherein said ball is captive in a space defined between a front end of said handle and the rear end of said casing;

the front end of said handle comprises a forwardly projecting portion and a chamber adjacent said forwardly projecting portion;

said ball assumes the locking position when said ball is located between the forwardly projecting portion and a rear face of the rear end of said casing and prevents further forward displacement of said handle toward the firing position;

said ball assumes a releasing position when said ball is located in said chamber without preventing forward displacement of said handle up to the firing position; and the front end of said handle further comprises a leading surface connecting the forwardly projecting portion and the chamber, said leading surface being inclined relative to an axial direction of said barrel sufficiently to cause said ball to roll under gravity from the releasing position to the locking position when said barrel is oriented horizontally.

2. The tool according to claim 1, wherein the firing mechanism includes a firing pin and a firing pin spring which is loaded by forward movement of the handle relative to said casing.

3. The tool according to claim 2, wherein the firing mechanism further includes a firing pin spring support which is forwardly moveable by forward movement of the handle relative to said casing; and a firing pin pawl displaceable by said firing pin spring support, thereby releasing the firing pin, when said handle is in the firing position.

4. The tool according to claim 1, wherein a forward end of the forwardly projecting portion of said handle has a further leading surface inclined relative to the axial direction of said barrel sufficiently to cause said ball to roll under gravity into the releasing position when said barrel is oriented when the barrel is orientated vertically upwardly or within a predetermined angle to the vertical.

5. The tool according to claim 4, wherein said leading surfaces are conical surfaces flaring forwardly of said casing.

6. The tool according to claim 4, wherein said space is annular.

7. The tool according to claim 4, wherein said further leading surface is a conical surface slanted at about 10 degrees relative to a plane perpendicular to the axial direction of said barrel.

8. The tool according to claim 1, wherein said leading surface is a conical surface slanted at about 10 degrees relative to the axial direction of said barrel.

9. An explosively actuated tool, comprising:

a casing;

a handle being moveable relative to and projecting from a rear end of said casing;

a barrel which projects from a front end of said casing and from which a fastener is to be fired by firing of an explosive charge;

a firing mechanism actuable by forward displacement of the handle to a firing position; and a safety lock device for inhibiting loading of the firing mechanism sufficiently to initiate firing unless the barrel is first orientated upwardly into a vertical or near vertical orientation, the lock device comprising a locking ball;

wherein when the barrel is oriented upwardly into said vertical or near vertical orientation, said ball will roll by gravity into a releasing position in which said ball is unable to inhibit loading and release of the firing mechanism; and when the barrel is lowered out of the vertical or near vertical orientation to be oriented in the horizontal, the ball will roll out of said releasing position into a blocking position in which said ball will block forward movement of the handle to the firing position, thereby preventing firing.

10. The tool according to claim 9, wherein the firing mechanism includes a firing pin, a firing pin spring, and a firing pin spring support carrying the firing pin spring and being attached to the handle via a coupling, whereby forward displacement of the support consequent on forward displacement of the handle loads the firing pin spring; and wherein, in the blocking position of the ball, the ball blocks movement of the firing pin spring support sufficiently to prevent firing by release of the firing pin.

11. The tool according to claim 10, wherein the coupling is mounted for movement within an enclosure at the rear end of the casing; and in the blocking position, the ball lies between a rearwardly-directed face of the enclosure and a forwardly-directed face of the coupling to thereby block forward movement of the coupling sufficient to enable firing.

12. The tool according to claim 11, wherein the releasing position in which the ball is unable to inhibit firing is within a chamber defined between the coupling and the firing pin spring support and into which the ball will roll when the barrel is orientated upwardly into the vertical or near vertical orientation.

13. The tool according to claim 9, wherein said ball is moveable by gravity from the releasing position to the blocking position when said barrel is oriented at an angle above the horizontal.

14. The tool according to claim 13, wherein said angle is about 10 degrees.

15. The tool according to claim 9, wherein said ball is moveable by gravity from the blocking position to the releasing position only when said barrel is oriented upwardly into said vertical or near vertical orientation.

16. The tool according to claim 9, wherein said ball is moveable by gravity from the blocking position to the releasing position only when said barrel is upwardly oriented within about 10 degrees off the vertical.

17. An explosively actuated tool, comprising:

a casing;

a handle being moveable relative to and projecting from a rear end of said casing;

a barrel which projects from a front end of said casing and from which a fastener is to be fired by firing of an explosive charge;

a firing mechanism actuable by forward displacement of the handle to a firing position; and safety locking means for inhibiting actuation of the firing mechanism when the barrel is oriented in the horizontal.

18. The tool according to claim 17, said safety locking means being released to allow actuation of the fixing mechanism only when said barrel is upwardly oriented within a predetermined acute angle off the vertical.

19. The tool according to claim 18, said safety locking means being engaged to prohibit actuation of the firing mechanism when said barrel is orientated upwardly at another predetermined acute angle off the horizontal.

20. The tool according to claim 19, wherein said predetermined angles are about 10 degrees.

* * * * *